US007358668B2

(12) United States Patent
Kwon

(10) Patent No.: US 7,358,668 B2
(45) Date of Patent: Apr. 15, 2008

(54) GREEN PHOSPHOR FOR PLASMA DISPLAY PANEL (PDP)

(75) Inventor: Seung-Uk Kwon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 525 days.

(21) Appl. No.: 10/990,974

(22) Filed: Nov. 18, 2004

(65) Prior Publication Data

US 2005/0116641 A1 Jun. 2, 2005

(30) Foreign Application Priority Data

Nov. 29, 2003 (KR) ..... 10-2003-0086115

(51) Int. Cl.
*H01J 17/49* (2006.01)

(52) U.S. Cl. ..... 313/582; 252/301.4 R; 252/301.6 R

(58) Field of Classification Search ..... 313/582–587, 313/486, 487, 503, 467; 252/301.4 R, 301.6 R, 252/301.6 F, 301.4 H
See application file for complete search history.

(56) References Cited

U.S. PATENT DOCUMENTS

| | | | | |
|---|---|---|---|---|
| 4,396,863 A | | 8/1983 | Ranby et al. | 313/486 |
| 5,541,618 A | | 7/1996 | Shinoda | 345/60 |
| 5,661,500 A | | 8/1997 | Shinoda et al. | 345/60 |
| 5,663,741 A | | 9/1997 | Kanazawa | 345/66 |
| 5,674,553 A | | 10/1997 | Shinoda et al. | 427/68 |
| 5,724,054 A | | 3/1998 | Shinoda | 345/60 |
| 5,786,794 A | | 7/1998 | Kishi et al. | 345/60 |
| 5,793,158 A | * | 8/1998 | Wedding, Sr. | 313/493 |
| 5,952,782 A | | 9/1999 | Nanto | 313/584 |

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Kanabi Gaharay
*Assistant Examiner*—Kevin Quarterman
(74) *Attorney, Agent, or Firm*—Robert E. Bushnell, Esq.

(57) ABSTRACT

A green phosphor for a Plasma Display Panel (PDP) includes a phosphor material selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor material.

22 Claims, 1 Drawing Sheet

U.S. PATENT DOCUMENTS

| | | | | |
|---|---|---|---|---|
| RE37,444 | E | 11/2001 | Kanazawa | 345/67 |
| 6,630,916 | B1 | 10/2003 | Shinoda | 345/60 |
| 6,707,436 | B2 | 3/2004 | Setoguchi et al. | 345/60 |
| 6,753,645 | B2 * | 6/2004 | Haruki et al. | 313/486 |
| 2004/0043692 | A1 * | 3/2004 | Kawamura et al. | 445/24 |

FOREIGN PATENT DOCUMENTS

| | | |
|---|---|---|
| JP | 06-299146 | 10/1994 |
| JP | 09-316443 | 9/1997 |
| JP | 2845183 | 10/1998 |
| JP | 2917279 | 4/1999 |
| JP | 2001-043804 | 2/2001 |
| JP | 2001-325888 | 11/2001 |
| JP | 2003-041248 | 2/2003 |
| JP | 2003-007215 | 10/2003 |
| JP | 00/69986 | 11/2003 |
| KR | 2000-60401 | 10/2000 |
| KR | 2001-62387 | 7/2001 |
| KR | 10-2003-0061471 | 7/2003 |

* cited by examiner

GREEN PHOSPHOR FOR PLASMA DISPLAY PANEL (PDP)

CLAIM OF PRIORITY

This application makes reference to, incorporates the same herein, and claims all benefits accruing under 35 U.S.C. § 119 from an application for GREEN PHOSPHOR FOR PLASMA DISPLAY PANEL earlier filed in the Korean Intellectual Property Office on 29 Nov. 2003 and thereby duly assigned Serial No. 10-2003-0086115.

BACKGROUND OF THE INVENTION

1. Field of the Invention

The present invention relates to a green phosphor for a Plasma Display Panel (PDP), and more particularly to a green phosphor for a PDP having an improved life-span and discharge stability.

2. Description of the Related Art

A Plasma Display Panel (PDP) is a flat display device using a plasma phenomenon, which is also called a gas-discharge phenomenon in which a discharge is generated in the PDP when a potential greater than a certain level is applied to two electrodes separated from each other in a gas atmosphere in a non-vacuum state. Such a gas-discharge phenomenon is applied to display an image in the PDP.

The currently generally used PDP is an Alternating Current (AC) driven PDP. The AC PDP has a structure in which a front substrate is disposed facing a rear substrate, with a discharge space between the two substrates. On the front substrate, a pair of retaining electrodes (scan electrode X, common electrode Y) are arranged in a certain pattern, each composed of a transparent electrode and a metal film. A dielectric layer is also coated thereon for the AC driving. The surface of the dielectric layer is coated with an MgO passivation layer. On the rear substrate, an address electrode A, a dielectric layer, a barrier rib, and a phosphor layer (R, G, B) are arranged.

The front substrate is disposed facing the rear substrate and is sealed. The internal space thereof is evacuated to reach a vacuum state, and the discharge gas is injected therein. The discharge gas may include any one or a mixture of inert gasses such as He, Ne, or Xe. Such a PDP includes three electrodes in its discharge space and a phosphor layer (R, G, B) which is as an array of red, green, and blue phosphor patterns. When a predetermined voltage is applied across the two electrodes to induce a plasma discharge, the fluorescent layer is excited by UV rays generated by the plasma discharge and emits light.

Typically, the phosphor used for the PDP is a phosphor that is excited by ultraviolet rays. As the green has the highest fraction on white brightness among R, G, and B, the green brightness is the most important for improving the PDP brightness. Currently, $Zn_2SiO4$:Mn, $BaAl_{12}O_{19}$:Mn, (Ba,Sr,Mg)O.a$Al_2O_3$:Mn (a is an integer of 1 to 23) are used for the green phosphor, and $Zn_2SiO_4$:Mn is the most popular due to its better brightness characteristics. However, it also has a defect in that the discharge characteristics are degenerated. The reason why the discharge characteristics of $Zn_2SiO_4$:Mn are degenerated will now be described in detail.

Since the MgO layer of the front substrate and the phosphor layer R, G, B of the rear substrate are directly exposed to the discharge space, the secondary electron emission coefficient of the MgO layer and the surface charge of the phosphor layer are directly affected by the amount of wall charge piled up on the phosphor layer and the MgO layer. During positive surface electrification, discharge failure is rarely generated, while during the negative surface electrification, discharge inferiority is frequently generated. This tendency is deeply dependant on the driving system. In order to increase the discharge stability and to decrease the discharge inferiority, it is preferable to select the R, G, B phosphor so that the surface electrification characteristic is positive regardless of the R, G, B color. Nevertheless, $Zn_2SiO_4$:Mn, the most popular green phosphor, has a negative surface electrification characteristic. Accordingly, when the PDP is driven in a driving waveform sensitive to the surface electrification characteristics of the phosphor layer, that is, the variation of the rear substrate, the discharge voltage of the green cell is higher than those of the red cell and the blue cell.

The mechanism to increase the discharge voltage may be described as follows: upon the reset discharge, the characteristic of driving an AC PDP during the real discharge, that is, before the discharge voltage is applied to the address electrode terminal, the wall charge is piled up. Before the discharge voltage is applied to the address electrode terminal, the wall charges having counter polarities are respectively piled up on the front substrate and the rear substrate. Thereby, a voltage differentiation is generated between the front and rear substrates.

Upon the voltage differentiation reaching a certain level, a voltage having the same polarity as the wall charge piled up on both the address electrode terminal and the scan electrode terminal is applied to discharge. Thus, the address discharge voltage is lowered by effectively piling the wall charge at an appropriate level. Before the discharge voltage is applied to the address electrode terminal, the cations pile up on the surface of the phosphor layer of the rear substrate as a wall charge. As the $Zn_2SiO_4$:Mn having negative surface electrification characteristics is counterbalanced by the wall charge of cations, the green cell generates a smaller discharge voltage that those of the red cell and blue cell. Accordingly, the green cell of $Zn_2SiO_4$:Mn may require a higher address voltage compared to the cases of the red cell and the blue cell, and sometimes, a discharge failure is generated.

In order to solve the problems relating to $Zn_2SiO_4$:Mn, Korean Laid-Open Patent Publication No. 2001-62387 relates to a green phosphor in which $YBO_3$:Tb is added to $Zn_2SiO_4$:Mn. However, the obtained green phosphor has deteriorated color purity. Furthermore, Korean Laid-Open Patent Publication No. 2000-60401 relates to a green phosphor in which a positive charged material of zinc oxide and magnesium oxide is added to $Zn_2SiO_4$:Mn. However, the green phosphor obtained from this method also causes problems in that the color purity and the lifespan are deteriorated. Still furthermore, Japanese Laid-Open Patent Publication No. 2003-7215 discloses that a mixture of manganese-activated aluminate green phosphor and terbium-activated phosphate or terbium-activated borate green phosphor can improve the driving voltage and the brightness failure.

SUMMARY OF THE INVENTION

An aspect of the present invention is to provide a green phosphor for a PDP having good lifespan characteristics and discharge stability.

In order satisfy these aspects, the present invention provides a green phosphor for a Plasma Display Panel (PDP), the green phosphor comprising: a phosphor material selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor material.

The present invention also provides a green phosphor for a Plasma Display Panel (PDP), the green phosphor comprising: a phosphor material selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material which is arranged in a layered structure including an $La_2O_3$ oxide coating layer and an $SiO_2$ oxide coating layer, wherein the $La_2O_3$ is present in an amount of less than 2500 ppm on the basis of the total amount of the phosphor material.

The present invention also provides a Plasma Display Panel (PDP) comprising: a pair of substrates having a transparent front surface and disposed to leave a discharge space therebetween; a plurality of barrier ribs disposed on one substrate to partition the discharge space into many spaces; a group of electrodes disposed on the substrates to discharge in the discharge spaces partitioned by the barrier ribs; and phosphor layers comprising red, green, and blue phosphors arranged in the discharge spaces partitioned by the barrier ribs; wherein the green phosphor comprises: a phosphor material selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor material.

The present invention also provides a Plasma Display Panel (PDP) comprising: a pair of substrates having a transparent front surface and disposed to leave a discharge space therebetween; a plurality of barrier ribs disposed on one substrate to partition the discharge space into many spaces; a group of electrodes disposed on the substrates to discharge in the discharge spaces partitioned by the barrier ribs; and phosphor layers comprising red, green, and blue phosphors arranged in the discharge spaces partitioned by the barrier ribs; wherein the green phosphor comprises: a phosphor material selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material which is arranged in layered structure including an $La_2O_3$ coating oxide layer and n $SiO_2$ coating oxide layer, wherein the $La_2O_3$ is present in an amount of less than 2500 ppm on the basis of the total amount of the phosphor.

BRIEF DESCRIPTION OF THE DRAWING

An exemplary embodiment of the present invention will be described herein below with reference to the accompanying drawings. In the following description, well-known functions or configurations are not described in detail since they would obscure the invention in unnecessary detail.

DETAILED DESCRIPTION OF THE INVENTION

Figure 1:
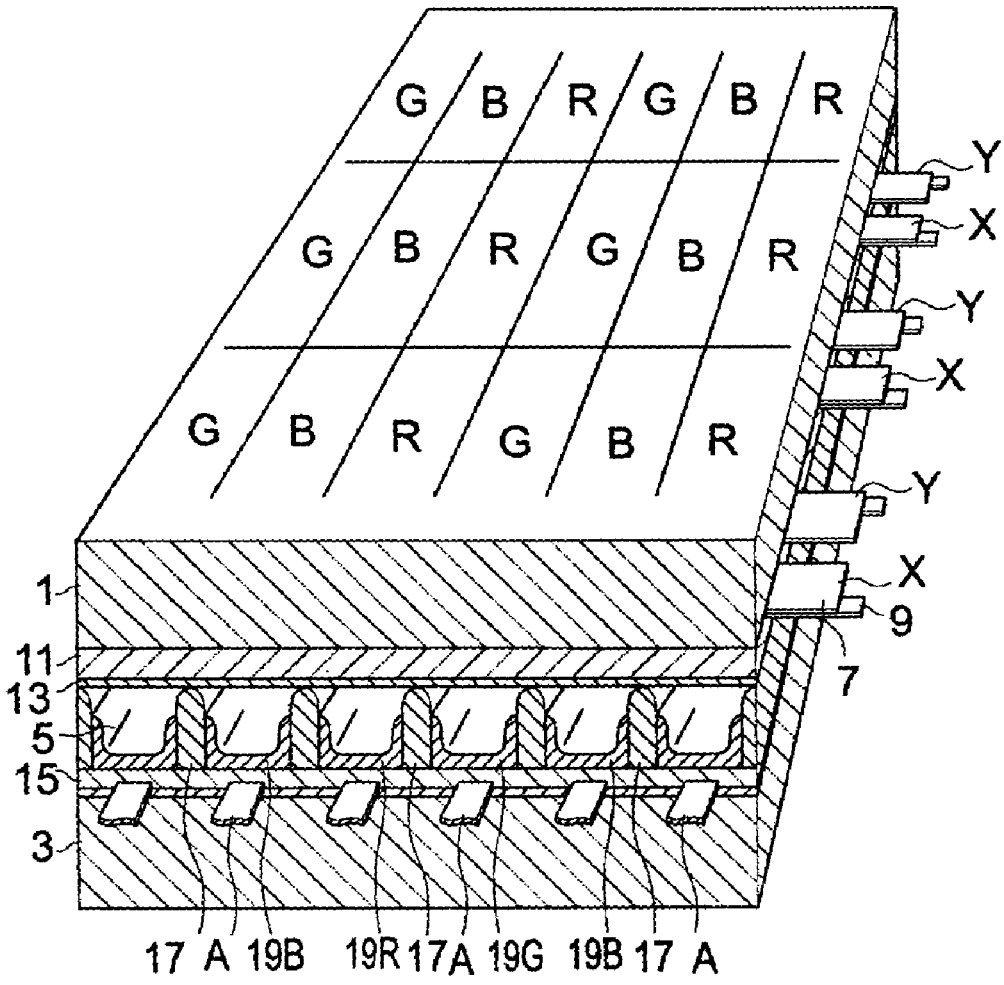
FIG. 1 is a perspective view of the internal structure of a PDP according to an embodiment of the present invention.

The currently generally used PDP is an Alternating Current (AC) driven PDP, as shown in FIG. 1. The AC PDP has a structure in which a front substrate 1 is disposed facing a rear substrate 3, with a discharge space 5 between the two substrates. On the front substrate 1, a pair of retaining electrodes (scan electrode X, common electrode Y) are arranged in a certain pattern, each composed of a transparent electrode 7 and a metal film 9. A dielectric layer 11 is also coated thereon for the AC driving. The surface of the dielectric layer 11 is coated with an MgO passivation layer 13. On the rear substrate 3, an address electrode A, a dielectric layer 15, a barrier rib 17, and a phosphor layer (19R, 19G, 19B) are arranged.

The front substrate is disposed facing the rear substrate and is sealed. The internal space thereof is evacuated to reach a vacuum state, and the discharge gas is injected therein. The discharge gas may include any one or a mixture of inert gasses such as He, Ne, or Xe. Such a PDP includes three electrodes in its discharge space and a phosphor layer (19R, 19G, 19B) which is as an array of red, green, and blue phosphor patterns. When a predetermined voltage is applied across the two electrodes to induce a plasma discharge, the fluorescent layer is excited by UV rays generated by the plasma discharge and emits light.

Typically, the phosphor used for the PDP is a phosphor that is excited by ultraviolet rays. As the green has the highest fraction on white brightness among R, G, and B, the green brightness is the most important for improving the PDP brightness. Currently, $Zn_2SiO4$:Mn, $BaAl_{12}O_{19}$:Mn, (Ba,Sr,Mg)O.a$Al_2O_3$:Mn (a is an integer of 1 to 23) are used for the green phosphor, and $Zn_2SiO_4$:Mn is the most popular due to its better brightness characteristics. However, it also has a defect in that the discharge characteristics are degenerated. The reason why the discharge characteristics of $Zn_2SiO_4$:Mn are degenerated will now be described in detail.

As shown in FIG. 1, since the MgO layer 13 of the front substrate 1 and the phosphor layer 19R, 19G, 19B of the rear substrate 3 are directly exposed to the discharge space, the secondary electron emission coefficient of the MgO layer and the surface charge of the phosphor layer are directly affected by the amount of wall charge piled up on the phosphor layer and the MgO layer. During positive surface electrification, discharge failure is rarely generated, while during negative surface electrification, discharge inferiority is frequently generated. This tendency is deeply dependant on the driving system. In order to increase the discharge stability and to decrease the discharge inferiority, it is preferable to select the R, G, B phosphor so that the surface electrification characteristic is positive regardless of the R, G, B color. Nevertheless, $Zn_2SiO_4$:Mn, the most popular green phosphor, has a negative surface electrification characteristic. Accordingly, when the PDP is driven in a driving waveform sensitive to the surface electrification characteristics of the phosphor layer, that is, the variation of the rear substrate, the discharge voltage of the green cell is higher than those of the red cell and the blue cell.

The mechanism to increase the discharge voltage may be described as follows: upon the reset discharge, the characteristic of driving an AC PDP during the real discharge, that is, before the discharge voltage is applied to the address electrode terminal, the wall charge is piled up. Before the discharge voltage is applied to the address electrode terminal, the wall charges having counter polarities are respectively piled up on the front substrate and the rear substrate. Thereby, a voltage differentiation is generated between the front and rear substrates.

Upon the voltage differentiation reaching a certain level, a voltage having the same polarity as the wall charge piled up on both the address electrode terminal and the scan electrode terminal is applied to discharge. Thus, the address discharge voltage is lowered by effectively piling the wall charge at an appropriate level. Before the discharge voltage is applied to the address electrode terminal, the cations pile up on the surface of the phosphor layer of the rear substrate as a wall charge. As the $Zn_2SiO_4$:Mn having negative surface electrification characteristics is counterbalanced by the wall charge of cations, the green cell generates a smaller discharge voltage that those of the red cell and blue cell. Accordingly, the green cell of $Zn_2SiO_4$:Mn may require a higher address voltage compared to the cases of the red cell and the blue cell, and sometimes, a discharge failure is generated.

In order to solve the problems relating to $Zn_2SiO_4$:Mn, Korean Laid-Open Patent Publication No. 2001-62387 discloses a green phosphor in which $YBO_3$:Tb is added to $Zn_2SiO_4$:Mn. However, the obtained green phosphor has a deteriorated color purity. Further, Korean Laid-Open Patent Publication No. 2000-60401 discloses a green phosphor in which a positive charged material of zinc oxide and magnesium oxide is added to $Zn_2SiO_4$:Mn. However, the green phosphor obtained from this method also causes problems in that the color purity and the life-span are deteriorated. Further, Japanese Laid-Open Patent Publication No. 2003-7215 discloses that a mixture of manganese-activated aluminate green phosphor and terbium-activated phosphate or terbium-activated borate green phosphor can improve the driving voltage and the brightness failure.

In order to realize uniform and stable discharge of a PDP, a surface potential of phosphor should be high and thus gaseous anions should collide with the phosphor layer at a high velocity. Therefore, the higher the surface potential of the phosphor, the larger the potential difference between the phosphor and anions, and stable emitting properties and plasma discharge can be realized.

In the present invention, a predetermined amount of $La_2O_3$ and $SiO_2$ oxide is coated of the surface of a phosphor material having a negative surface potential, resulting in an improvement of discharge properties and lifespan characteristics of the phosphor. The phosphor includes any phosphor having a negative surface potential, specific examples of the phosphor including $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd).

$La_2O_3$ is coated in an amount less than 2500 ppm so as to modify the surface potential, and $SiO_2$ is coated so as to solve shortcomings of lifespan deterioration which are caused from the $La_2O_3$ coating. The amount of $La_2O_3$ advantageously ranges from more than or equal to 50 ppm and less than or equal to 2500 ppm, more advantageously from more than or equal to 300 ppm and less than or equal to 2000 ppm, and still more advantageously from more than or equal to 600 ppm and less than or equal to 900 ppm. The amount of $SiO_2$ advantageously ranges less than or equal to 600 ppm, more advantageously from more than or equal to 10 ppm and less than or equal to 600 ppm, still more advantageously from more than or equal to 50 ppm and less than or equal to 500 ppm, and most advantageously from more than or equal to 100 ppm and less than or equal to 250 ppm. When the coating amount of $La_2O_3$ is more than 2500 ppm, the surface potential can be modified, but the phosphor can be deteriorated by VUV and the brightness and lifespan can be deteriorated. When the coating amount of $SiO_2$ is more than 600 ppm, the surface potential modification cannot be sufficient.

The weight ratio of $La_2O_3$ and $SiO_2$ present in the coating advantageously ranges about 4.5:1 to 30:1, and more advantageously, 19:1 to 24:1. When the coating amount is within the above range, both the surface potential modification and life-span characteristics can be improved. The thickness of the coating is advantageously less than or equal to 30 nm, and more advantageously less than or equal to 10 nm, and thus emitting properties can be maintained at a good level.

The coating of $La_2O_3$ and $SiO_2$ may be formed using a deposition process where oxide sources are deposited on the surface of the phosphor. The deposition process can be performed by any suitable method, such as plasma chemical vapor deposition (PVD), chemical vapor deposition (CVD), sputtering, electron beam evaporation, vacuum thermal evaporation, laser ablation, thermal evaporation, laser chemical vapor deposition, or jet vapor deposition, but is not limited thereto.

$La_2O_3$ and $SiO_2$ oxide coatings can be present in one coating layer or separate coating layers. For example, a first coating layer including $La_2O_3$ can be present on the surface of the phosphor, and a second coating layer including $SiO_2$ can be arranged on the first coating. The amount of $La_2O_3$ advantageously ranges from more than or equal to 100 ppm and less than or equal to 2500 ppm, and more advantageously from more than or equal to 600 ppm and less than or equal to 900 ppm. The amount of $SiO_2$ advantageously ranges from more than or equal to 50 ppm and less than or equal to 600 ppm, and more advantageously from more than or equal to 100 ppm and less than or equal to 250 ppm. When the coating amount of $La_2O_3$ is more than 2500 ppm, the surface potential can be modified, but the phosphor can be deteriorated by VUV and the brightness and lifespan can be deteriorated. When the coating amount of $SiO_2$ is more than 600 ppm, the surface potential modification cannot be sufficient.

The weight ratio of $La_2O_3$ and $SiO_2$ present in the coating advantageously ranges about 4.5:1 to 30:1, and more advantageously, 19:1 to 24:1. When the coating amount is within the above range, both the surface potential modification and life-span characteristics can be improved.

The coated phosphor may be mixed with an uncoated phosphor. The phosphor is advantageously used in an amount of more than or equal to 10% by weight, and more advantageously more than or equal to 40% by weight based on the total weight of phosphor. When the amount of the coated phosphor is less than 10% by weight, the surface potential modification efficacy cannot be obtained.

A plasma display is manufactured by forming a green phosphor layer in discharge cell using the green phosphor.

The green phosphors of the present invention are dispersed in a vehicle in which a binder resin is dissolved in a solvent to provide a phosphor paste composition.

Examples of the binder include cellulose resins, acrylic resins, and mixtures thereof. Examples of cellulose resins include methyl cellulose, ethyl cellulose, propyl cellulose, hydroxymethyl cellulose, hydroxyethyl cellulose, hydroxypropyl cellulose, hydroxyethyl propyl cellulose, and mixtures of the forgoing celluloses. Examples of acrylic resins include polymethyl methacrylate; polyisopropyl methacrylate; polyisobutyl methacrylate; copolymers of acrylic monomers, such as methyl methacrylate, ethyl methacrylate, propyl methacrylate, butyl methacrylate, hexyl methacrylate, 2-ethylhexyl methacrylate, benzyl methacrylate, dimethylaminoethyl methacrylate, hydroxyethyl methacrylate, hydroxypropyl methacrylate, hydroxybutyl methacrylate, phenoxy-2-hydroxypropyl methacrylate, glycidyl methacrylate, methyl acrylate, ethyl acrylate, propyl acrylate, butyl acrylate, hexyl acrylate, 2-ethylhexyl acrylate, benzyl acrylate, dimethylaminoethyl acrylate, hydroxyethyl acrylate, hydroxypropyl acrylate, hydroxybutyl acrylate, phenoxy-2-hydroxypropyl acrylate, glycidyl acrylate, and the like; and mixtures thereof. The phosphor paste composition according to the present invention may further include a small amount of inorganic binder. The amount of the binder may be in the range of about 2 to 8% by weight based on the total weight of the phosphor paste composition.

Examples of the solvent for the phosphor paste composition include alcohols, ethers, esters, and mixtures of the forgoing solvents. Preferred examples of the solvent include butyl cellosolve (BC), butyl carbitol acetate (BCA), terpineol, and a mixture thereof. If the amount of the solvent is too large or too small, the fluidity of the phosphor paste composition is not suitable for coating. In consideration of this effect, the amount of the solvent may be in the range of, for example, about 25-75% by weight.

The phosphor paste composition according to the present invention may further include an additive for improved fluidity and processing properties. Various kinds of additives, for example, a photosensitizer such as benzophenone, a dispersing agent, a silicon-based antifoaming agent, a rheology modifier, a plasticizer, an antioxidant, and the like, may be used individually or in combination. Commercially available additives well known to those skilled in the art may be used for these purposes.

Any method of manufacturing a phosphor layer and other elements of PDPs and any structure thereof that are widely known may be applied to a PDP according to the present invention. Therefore, detailed descriptions of a method of manufacturing a PDP according to the present invention and its structure are not provided here.

The obtained phosphor paste is coated on the surface to provide a phosphor layer. The surface to be coated is a dielectric layer 15 on the surface of the back substrate 3, and side walls of the barrier ribs 17 as shown in FIG. 1. The coating method of the phosphor paste may include, but is not limited to, screen printing or spraying the phosphor paste from a nozzle. The coated paste layer is then sintered at a temperature sufficient to discompose or burn the binder resin, to provide a phosphor layer.

The following examples illustrate the present invention in further detail. However, it is understood that the present invention is not limited by these examples.

EXAMPLES AND COMPARATIVE EXAMPLES

A coating layer was formed on the surface of $Zn_2SiO_4$:Mn by deposition using a target including $La_2O_3$ and $SiO_2$ with a diameter of 4 inches under a pressure of 5 mTorr, an RF power of 300 W, and an argon atmosphere. Coating amounts of $La_2O_3$ and $SiO_2$ are as shown in Table 1.

TABLE 1

| | $La_2O_3$ amount (ppm) | $SiO_2$ amount (ppm) |
|---|---|---|
| Comparative Example 1 | — | — |
| Comparative Example 2 | 2400 | — |
| Comparative Example 3 | 4700 | — |
| Example 1 | 850 | 90 |
| Example 2 | 850 | 580 |
| Example 3 | 2400 | 180 |
| Example 4 | 2400 | 730 |
| Comparative Example 4 | 4700 | 290 |

The green phosphors of Examples 1 to 4 and Comparative Examples 1 to 4 were dispersed in a vehicle in which ethyl cellulose was dissolved in butyl carbitol acetate to obtain a phosphor paste. The phosphor paste was screen-printed between diaphragms shown in FIG. 1 and sintered at 500 degrees to provide PDPs having the phosphor layer.

After only the green phosphor pattern of each of the PDPs was excited, the color coordinates, according to the CIE colorimetric system, of green light emitted from the PDPs, the brightness of the green light using a calorimeter (CA-100), and brightness maintenance ratio (lifespan) with respect to VUV were measured.

The surface electric charge of the phosphor powder was measured using TB-200 (measurement equipment of electric charge, manufactured by Toshiba Chemical Co.), and zeta potential was measured using Zeta Master (manufactured by Malvern Company). The measurement results are shown in Table 2. In Table 2, relative brightness is calculated as a percentage value based on brightness of phosphor according to Comparative Example 1.

TABLE 2

| | Color coordinate x | Color coordinate y | Relative brightness (%) | brightness maintenance ratio (%) | surface electric charge (μC/g) | zeta potential (mV) |
|---|---|---|---|---|---|---|
| Comparative Example 1 | 0.244 | 0.697 | 100 | 91% | −32 | −42 |

TABLE 2-continued

| | Color coordinate x | Color coordinate y | Relative brightness (%) | brightness maintenance ratio (%) | surface electric charge (μC/g) | zeta potential (mV) |
|---|---|---|---|---|---|---|
| Comparative Example 2 | 0.244 | 0.697 | 93.3% | 71% | +71 | 85 |
| Comparative Example 3 | 0.244 | 0.697 | 88.7% | 69% | +77 | 103 |
| Example 1 | 0.244 | 0.697 | 99.8 | 90% | +56 | 46 |
| Example 2 | 0.244 | 0.697 | 112 | 88% | +48 | 40 |
| Example 3 | 0.244 | 0.697 | 91.6% | 79% | +67 | 74 |
| Example 4 | 0.244 | 0.697 | 90.3% | 82% | +45 | 53 |
| Comparative Example 4 | 0.244 | 0.697 | 87.7% | 74% | +72 | 86 |

As shown in Table 2, oxide coating does not have an effect on the color coordinates. As the coating amount of $Li_2O_3$ increases, the brightness maintenance ratio (lifespan) with respect to vacuum ultraviolet rays deteriorates (see Comparative Examples 1 to 3). On the contrary, in the case of Examples 1 to 4 where $Li_2O_3$ is coated in an amount less than 2400 ppm and $SiO_2$ is coated, surface potentials of phosphors were improved much better than that of the phosphor according to Comparative Example 1, and the brightness maintenance ratios with respect to vacuum ultraviolet rays were maintained at a good level.

The high surface electric charges and high zeta potentials of phosphors according to Example 1 to 3 represent discharge stability in PDPs. In order to verify the above fact, discharge variation, address margin, and brightness maintenance ratio of PDPs manufactured using phosphors according to Examples 1 to 3 were measured. The results are shown in Table 3.

TABLE 3

| | Discharge variation | Address margin(V) | Brightness maintenance ratio (%) 96 hours | 480 hours | 960 hours |
|---|---|---|---|---|---|
| Comparative Example 1 | 478 | 5 | 98 | 95 | 93 |
| Example 1 | 52 | 21 | 99 | 96 | 94 |
| Example 2 | 102 | 17 | 98 | 95 | 92 |
| Example 3 | 43 | 24% | 97 | 93 | 89 |

In Table 3, discharge variation which is value indicating the discharge stability is calculated as follows:

$$Nt/No=\exp(-(t-tf)/ts)$$

where Nt denotes a number of times in which discharge fails to occur (i.e., discharge error) during the period of time t, No denotes a number of times counting the delay of discharge, tf denotes a delay in formation, and ts denotes a discharge variation. The discharge stability was evaluated based on the number of times of discharge errors Nt and discharge variation ts. As ts, i.e. a parameter representing the discharge variation, is smaller, the discharge error is reduced. Address margin voltage is the difference between rated address voltage and minimal address voltage.

As shown in Table 3, PDPs comprising the phosphors according to Examples 1 to 3 shows good brightness maintenance ratios (lifespan), discharge variations which decrease by less than by about ⅕ based on that of Comparative Example 1, and more than three times the address margin voltage, indicating that their discharge stability is good.

As described above, PDPs with good life-span characteristics and discharge stability can be provided by surface-treating phosphor having a low surface potential with an oxide such as $La_2O_3$ and $SiO_2$.

What is claimed is:

1. A green phosphor for a Plasma Display Panel (PDP), the green phosphor comprising:

a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor material.

2. The green phosphor according to claim 1, wherein the $La_2O_3$ is coated in an amount of 50 ppm to 2500 ppm on the basis of the total amount of the phosphor material.

3. The green phosphor according to claim 1, wherein the $SiO_2$ is coated in an amount of less than 600 ppm on the basis of the total amount of the phosphor material.

4. The green phosphor according to claim 1, wherein the $La_2O_3$ and $SiO_2$ are present in a weight ratio of 4.5:1 to 30:1.

5. A green phosphor for a Plasma Display Panel (PDP), the green phosphor comprising;

a first phosphor including a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor; and an uncoated second phosphor selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd).

6. The phosphor according to claim 5, where the first phosphor is present in an amount of 10 to 100% by weight.

7. A green phosphor for a Plasma Display Panel (PDP), the green phosphor comprising:

a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material which is arranged in a layered structure including an $La_2O_3$ oxide coating layer and an $SiO_2$ oxide coating layer, wherein the $La_2O_3$ is present in an amount of less than 2500 ppm on the basis of the total amount of the phosphor material.

8. The green phosphor according to claim 7, wherein the $La_2O_3$ is coated in an amount of 50 ppm to 2500 ppm on the basis of the total amount of the phosphor material.

9. The green phosphor according to claim 7, wherein the $SiO_2$ is coated in an amount of less than 600 ppm on the basis of the total amount of the phosphor material.

10. The green phosphor according to claim 7, wherein the $La_2O_3$ and $SiO_2$ are present in a weight ratio of 4.5:1 to 30:1.

11. A green phosphor for a Plasma Display Panel (PDP), the green phosphor comprising;

a first phosphor including a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material which is arranged in layered structure including an $La_2O_3$ oxide coating layer and an $SiO_2$ oxide coating layer, wherein the $La_2O_3$ is present in an amount of less than 2500 ppm on the basis of the total amount of the phosphor material; and an uncoated second phosphor selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd).

12. The phosphor according to claim 11, where the first phosphor is present in an amount of 10 to 100% by weight.

13. A Plasma Display Panel (PDP) comprising a pair of substrates having a transparent front surface, the pair of substrates arranged to define a discharge space therebetween, a plurality of barrier ribs disposed on one of the pair of substrates to partition the discharge space into a plurality of discharge spaces;

a plurality of electrodes arranged on the pair of substrates and adapted to discharge in the plurality of discharge spaces partitioned by the plurality of barrier ribs; and phosphor layers comprising red, green, and blue phosphors arranged in the plurality of discharge spaces partitioned by the plurality of barrier ribs;

wherein the green phosphor comprises:

a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material and including $La_2O_3$ and $SiO_2$, wherein the $La_2O_3$ is present in an amount of less than 2500 ppm on the basis of the total amount of the phosphor material.

14. The Plasma Display Panel (PDP) according to claim 13, wherein the $La_2O_3$ is coated in an amount of 50 ppm to 2500 ppm on the basis of the total amount of the phosphor material.

15. The Plasma Display Panel (PDP) according to claim 13, wherein the $SiO_2$ is coated in an amount of less than 600 ppm on the basis of the total amount of the phosphor material.

16. The Plasma Display Panel (PDP) according to claim 13, wherein the $La_2O_3$ and $SiO_2$ are present in a weight ratio of 4.5:1 to 30:1.

17. The Plasma Display Panel (PDP) according to claim 13, wherein the phosphor layer further comprises an uncoated phosphor selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd).

18. A Plasma Display Panel (PDP) comprising:

a pair of substrates having a transparent front surface, the pair of substrates arranged to define a discharge space therebetween;

a plurality of barrier ribs disposed on one of the pair of substrates to partition the discharge space into a plurality of discharge spaces;

a plurality of electrodes arranged on the substrates and adapted to discharge in the plurality of discharge spaces partitioned by the plurality of barrier ribs, and phosphor layers comprising red, green, and blue phosphors arranged in the plurality of discharge spaces partitioned by the plurality of barrier ribs;

wherein the green phosphor comprises:

a phosphor material selected from the group consisting of $Zn_2SiO_4$:Mn, $(Zn,A)_2SiO_4$:Mn (A is an alkaline earth metal), $(Ba,Sr,Mg)O.aAl_2O_3$:Mn (a is an integer in the range of 1 to 23), MgAlxOy:Mn (x is an integer in the range of 1 to 10, and y is an integer in the range of 0.1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd); and an oxide material coated on the surface of the phosphor material which is arranged in a layered structure including an $La_2O_3$ oxide coating layer and an $SiO_2$ oxide coating layer, wherein the $La_2O_3$ is present in an amount of less than 2500 ppm on the basis of the total amount of the phosphor material.

19. The Plasma Display Panel (PDP) according to claim 18, wherein the $La_2O_3$ is coated in an amount of 50 ppm to 2500 ppm on the basis of the total amount of the phosphor material.

20. The Plasma Display Panel (PDP) according to claim 18, wherein the $SiO_2$ is coated in an amount of less than 600 ppm on the basis of the total amount of the phosphor material.

21. The Plasma Display Panel (PDP) according to claim 18, wherein the $La_2O_3$ and $SiO_2$ are present in a weight ratio of 4.5:1 to 30:1.

22. The Plasma Display Panel (PDP) according to claim 18, wherein the phosphor layer further comprises an uncoated phosphor selected from the group consisting of $Zn_2SiO_4$:Mn, $(Zn,A)_2SiO_4$:Mn (A is an alkaline earth metal), (Ba,Sr,Mg)O.a$Al_2O_3$:Mn (a is an integer in the range of 1 to 23), MgAlxOy:Mn (x is an integer in the range of 1 to 10, and y is an integer in the range of 1 to 30), LaMgAlxOy:Tb (x is an integer in the range of 1 to 14, and y is an integer in the range of 8 to 47), and $ReBO_3$:Tb (Re is a rare earth element selected from the group consisting of Sc, Y, La, Ce, and Gd).

* * * * *